US007036679B2

(12) United States Patent
Baranowski

(10) Patent No.: US 7,036,679 B2
(45) Date of Patent: May 2, 2006

(54) DISPENSING AND DIVERSION SYSTEMS AND METHODS

(76) Inventor: John Baranowski, 1653 Britany Dr., Bensalem, PA (US) 19020

( * ) Notice: Subject to any disclaimer, the term of this patent is extended or adjusted under 35 U.S.C. 154(b) by 159 days.

(21) Appl. No.: 10/601,670

(22) Filed: Jun. 24, 2003

(65) Prior Publication Data

US 2004/0007584 A1 Jan. 15, 2004

Related U.S. Application Data

(60) Provisional application No. 60/454,596, filed on Mar. 17, 2003, provisional application No. 60/390,371, filed on Jun. 24, 2002.

(51) Int. Cl.
*G07F 11/00* (2006.01)

(52) U.S. Cl. ..... 221/13; 209/592

(58) Field of Classification Search ..... 221/277, 221/9, 13, 119, 120, 1; 209/592, 576, 580, 209/571, 920, 552
See application file for complete search history.

(56) References Cited

U.S. PATENT DOCUMENTS

| | | | | |
|---|---|---|---|---|
| 3,578,094 | A | 5/1971 | Henry et al. | |
| 3,631,903 | A | 1/1972 | Huggins | |
| 3,696,584 | A | 10/1972 | Rickard | |
| 3,782,878 | A | 1/1974 | Hudson | |
| 3,796,351 | A | 3/1974 | Kohl et al. | |
| 3,822,032 | A | 7/1974 | Vergobbi | |
| 3,828,869 | A | 8/1974 | Sellers | |
| 3,877,205 | A | 4/1975 | Gundersen | |
| 3,938,601 | A | 2/1976 | Hobart | |
| 4,053,003 | A | 10/1977 | Ferrero et al. | |
| 4,122,876 | A | 10/1978 | Nalbach | |
| 4,191,294 | A * | 3/1980 | McGrath et al. | 209/135 |
| 4,192,359 | A | 3/1980 | Pippin | |
| 4,193,465 | A | 3/1980 | Henry | |
| 4,248,027 | A | 2/1981 | Cleary et al. | |
| 4,385,670 | A | 5/1983 | Braun et al. | |
| 4,398,612 | A | 8/1983 | Mikami et al. | |
| 4,431,070 | A | 2/1984 | Andrews | |
| 4,456,117 | A | 6/1984 | Szczepanski | |
| 4,516,644 | A | 5/1985 | Fukuda | |
| 4,527,647 | A | 7/1985 | Ueda | |
| 4,534,428 | A | 8/1985 | Mosher et al. | |
| 4,534,429 | A | 8/1985 | Konishi | |
| 4,540,082 | A | 9/1985 | Maddocks | |
| 4,552,236 | A | 11/1985 | Mikami | |

(Continued)

FOREIGN PATENT DOCUMENTS

DE 900795 1/1954

(Continued)

OTHER PUBLICATIONS

PCT International Search Report (PCT/US03/19730), dated Sep. 25, 2003.

(Continued)

*Primary Examiner*—Kenneth Noland
(74) *Attorney, Agent, or Firm*—Baker Botts, LLP

(57) ABSTRACT

A system for dispensing items includes a dispenser, a sensing unit, a plurality of container chutes, and a plurality of diversion chutes. The dispenser comprises a plurality of dispensing paths for dispensing the items. The sensing unit measures a physical characteristic of each of the dispensed items. The plurality of container chutes directs each of the dispensed items, the measured physical characteristic of which is within a predetermined range of physical characteristics, to containers. The plurality of diversion chutes diverts each of the dispensed items, the measured physical characteristic of which is greater than or less than the predetermined range of physical characteristics, away from the containers.

27 Claims, 9 Drawing Sheets

U.S. PATENT DOCUMENTS

| | | | | |
|---|---|---|---|---|
| 4,561,510 | A | | 12/1985 | Sugioka et al. |
| 4,570,419 | A | | 2/1986 | Tinsley |
| 4,576,209 | A | | 3/1986 | Eisenberg |
| 4,595,125 | A | | 6/1986 | Alwerud |
| 4,687,672 | A | | 8/1987 | Vitkovsky |
| 4,708,215 | A | | 11/1987 | Nakamura et al. |
| 4,721,173 | A | | 1/1988 | Hirota et al. |
| 4,723,614 | A | | 2/1988 | Lahti |
| 4,733,520 | A | | 3/1988 | Rabbi |
| 4,784,275 | A | * | 11/1988 | Fridge ..... 209/558 |
| 4,844,190 | A | | 7/1989 | Mikami et al. |
| 4,999,977 | A | | 3/1991 | Briscoe et al. |
| 5,081,822 | A | | 1/1992 | Boyd et al. |
| 5,104,002 | A | | 4/1992 | Cahlander et al. |
| 5,108,012 | A | | 4/1992 | Rosso |
| 5,195,294 | A | | 3/1993 | Baranowski |
| 5,195,298 | A | | 3/1993 | Baranowski |
| 5,246,118 | A | | 9/1993 | Mosher |
| 5,313,508 | A | | 5/1994 | Ditman et al. |
| 5,355,991 | A | | 10/1994 | Baranowski |
| 5,407,057 | A | | 4/1995 | Baranowski |
| 5,415,321 | A | | 5/1995 | Gehlert et al. |
| 5,454,016 | A | | 9/1995 | Holmes |
| 5,454,465 | A | | 10/1995 | Baranowski |
| 5,456,931 | A | | 10/1995 | Egger et al. |
| 5,458,055 | A | | 10/1995 | Fitch, Jr. |
| 5,522,512 | A | * | 6/1996 | Archer et al. ..... 209/580 |
| 5,613,590 | A | | 3/1997 | Simionato |
| 5,638,417 | A | | 6/1997 | Boyer et al. |
| 5,638,657 | A | | 6/1997 | Archer et al. |
| 5,692,594 | A | | 12/1997 | Sidler |
| 5,726,394 | A | | 3/1998 | Krämer sen. et al. |
| 5,756,939 | A | | 5/1998 | Taniguchi |
| 5,762,113 | A | | 6/1998 | Ricossa et al. |
| 5,767,455 | A | | 6/1998 | Mosher |
| 5,804,772 | A | | 9/1998 | Wooldridge et al. |
| 5,829,493 | A | | 11/1998 | Baranowski |
| 5,878,865 | A | | 3/1999 | Bailey et al. |
| 5,938,074 | A | | 8/1999 | Dartus |
| 5,942,732 | A | | 8/1999 | Holmes |
| 6,098,785 | A | | 8/2000 | Van Maanen |
| 6,268,571 | B1 | | 7/2001 | Benyukhis |
| 6,273,238 | B1 | | 8/2001 | Wooldridge |
| 6,318,594 | B1 | | 11/2001 | Hutchins |
| 6,338,371 | B1 | | 1/2002 | Araki et al. |
| 6,351,676 | B1 | * | 2/2002 | Thomas ..... 700/28 |
| 6,360,870 | B1 | | 3/2002 | Wooldridge |
| 6,421,982 | B1 | | 7/2002 | Eichenberger |
| 6,431,407 | B1 | | 8/2002 | Hogan et al. |
| 2002/0134050 | A1 | | 9/2002 | Thieman |

FOREIGN PATENT DOCUMENTS

| | | |
|---|---|---|
| EP | 0195428 | 9/1986 |
| EP | 0678738 | 10/1995 |
| WO | 9919215 | 4/1999 |
| WO | 0020306 | 4/2000 |
| WO | 0138202 | 5/2001 |
| WO | 02077582 | 10/2002 |

OTHER PUBLICATIONS

Barry Graham and Paula madden, Precision Feeding For Coating and Plating Processes, Fastener Technology International (Jun. 2000).

Donald Wooldridge, New Packaging Line For Fastener Kits, Fastener Technology International (Dec. 1997).

Gina Donliu, RTA Hardware Gains Precision Packaging, Furniture Design and Manufacturing (Dec. 1994).

Batching Systems Inc., Labor Savings Drive Auto Parts vf/f/s Bagging, Packaging Digest (Oct. 1996).

Batching Systems Inc., Batching Systems Kit Packaging Systems, Brochure (Feb. 1998).

Batching Systems Inc., Bagmaster ®T Series Baggers, Brochure (May 2000).

Batching Systems Inc., Aucillary Equipment, Brochure (Feb. 1998).

Batching Systems Inc., Batchmaster ®FAW (Fast Automatic Weigher), Brochure (Dec. 1999).

FMC Technologies, Syntron® Material Handling Solutions, Rotary Bowl Feeders, (at least as early as Apr. 2002).

FMC Technologies, Syntron® Material Handling Solutions, Electromagnetic Vibrating Feeders (Light Duty) (at least as early as Jan. 2004).

NTI Ltd., LinMot® Linear Servo Motors, (Jun. 2001).

Quicksilver Controls, Inc., SilverMax™ Fully Integrated Servomoters, Dec. 2001.

Batching Systems Inc., Batch 'n Clamshell Packaging Systems, Brochure (Jul. 2000).

Batching Systems, Inc., Bagmaster® C Series Baggers—Centerfold Web Style Machine, Brochure (Feb. 1998).

Batching Systems, Inc., Bagmaster® F Series Bagger—Flat Web Style Machine, Brochure (Feb. 1998).

Batching Systems, Inc., Batchmaster® Ultra, Brochure (Feb. 1998).

Batching Systems, Inc., Batchmaster® Counters, Brochure (Dec. 1999).

* cited by examiner

DISPENSING AND DIVERSION SYSTEMS AND METHODS

This application claims priority from U.S. Provisional Patent Application No. 60/390,371 entitled "Dispensing and Diversion Systems and Methods," and filed on Jun. 24, 2002, and U.S. Provisional Patent Application No. 60/454,596 entitled "Dispensing and Diversion Systems and Methods," and filed on Mar. 17, 2003, the disclosures of which are incorporated herein by reference in their entirety.

BACKGROUND OF THE INVENTION

1. Field of the Invention

The present invention relates generally to dispensing systems and methods. In particular, the present invention relates to dispensing systems and methods in which a plurality of items may be dispensed, such that dispensed items may be directed to containers or diverted away from containers depending upon a measured physical characteristic of each of the dispensed items.

2. Description of Related Art

In known dispensing systems and methods, a dispenser may receive and dispense a plurality of items. For example, a known dispenser may receive a plurality of items on an item-receiving surface, direct the items from the item-receiving surface to dispensing paths positioned around the item-receiving surface, and dispense the items from the dispensing paths. Moreover, known dispensing systems may count each dispensed item, so that predetermined quantities of items may be directed to containers, e.g., packages, boxes, bottles, jars, cans, bowls, plates, pans, and the like.

However, known dispensing systems may dispense items that are out-of-specification, i.e., items that have a measured physical characteristic that is greater than or less than a predetermined range of physical characteristics for that item. If within a plurality of items to be dispensed, some items have a physical characteristic that is greater than or less than a predetermined range of physical characteristics for that item, a problem may arise in maintaining a quality of items dispensed to each container. For example, known dispensing systems may receive and dispense out-of-specification items, i.e., items having a volume, density, or weight that is greater than or less than a predetermined range of volumes, densities, or weights for that particular item. If within a plurality of items to be dispensed, some of the items are "out-of-specification", known dispensers may dispense the out-of-specification items to containers. Thus, containers may have one or more items, the measured physical characteristic of which is greater than or less than a predetermined range of physical characteristics for that item.

SUMMARY OF THE INVENTION

A need has arisen for dispensing systems and methods that dispense items in predetermined quantities to containers. More particularly, a need has arisen for dispensing systems that accurately measure a physical characteristic of each dispensed item and direct predetermined quantities of dispensed items, the measured physical characteristic of which is within a predetermined range of physical characteristics, to a container. A further need has arisen for dispensing systems and methods that divert items, the measured physical characteristic of which is greater than or less than a predetermined range of physical characteristics, away from a container.

Dispensing systems of the present invention may dispense predetermined quantities of a variety of food items, e.g., dried food items, frozen food items, thawed food items, or the like. For example, such dispensing systems may dispense dried food items, such as dried pasta, dehydrated vegetables, or the like. Moreover, such dispensing systems may dispense frozen food items, e.g., frozen meat, frozen vegetables, or the like. The dispensing system of the present invention may dispense items of varying physical characteristic, e.g., varying weight, volume, density, temperature, or the like, including non-food items. For example, the dispensing system of the present invention may dispense fasteners, hardware, medical items, electronic parts, mechanical parts, metallic and non-metallic items, or the like.

In an embodiment of the invention, a system for dispensing items comprises a dispenser, a sensing unit, a plurality of container chutes, and a plurality of diversion chutes. The dispenser comprises a plurality of dispensing paths for dispensing the items. The sensing unit measures a physical characteristic of each of the dispensed items. The plurality of container chutes directs each of the dispensed items, the measured physical characteristic of which is within a predetermined range of physical characteristics, to containers. The plurality of diversion chutes diverts each of the dispensed items, the measured physical characteristic of which is greater than or less than the predetermined range of physical characteristics, away from the containers.

In another embodiment of the invention, a dispensing system comprises a rotary, vibratory dispenser for receiving and dispensing items, at least one sensing unit, a plurality of container chutes, and a plurality of diversion chutes. The rotary, vibratory dispenser comprises a rotation drive for rotating said dispenser, a plurality of dispensing paths, and at least one vibration device for vibrating the plurality of dispensing paths, so that the plurality of dispensing paths dispenses the items singularly. The at least one sensing unit measures a physical characteristic of each of the singularly-dispensed items. The plurality of container chutes direct each of the singularly-dispensed items, the measured physical characteristic of which is within a predetermined range of physical characteristics, to containers. The plurality of diversion chutes diverts each of the singularly-dispensed items, the measured physical characteristic of which is greater than or less than the predetermined range of physical characteristics, away from the containers.

In a further embodiment of the invention, a dispensing method comprises the steps of dispensing items from a dispenser. A physical characteristic of each of the dispensed items is measured. Each of the dispensed items, the measured physical characteristic of which is within a predetermined range of physical characteristics, is directed to a container chute. Each of the items, the measured physical characteristic of which is greater than or less than the predetermined range of physical characteristics, to a diversion chute.

In yet another embodiment of the invention, a dispensing method comprises the steps of dispensing items singularly from a rotary, vibratory dispenser. A physical characteristic of each of the singularly-dispensed items is measured. Each of the singularly-dispensed items, the measured physical characteristic of which is within a predetermined range of physical characteristics is directed to a container. Each of the dispensed items, the measured physical characteristic of which is greater than or less than the predetermined range of physical characteristics, is diverted away from the container. The diverted items are conveyed to a rejection bin.

A system for dispensing items comprises a dispenser, a sensing unit, and a plurality of container chutes, and a plurality of buckets. The dispenser comprises a plurality of dispensing paths for dispensing items. The sensing unit measures a physical characteristic of each of the dispensed items. The plurality of container chutes directs each of the dispensed items, the measured physical characteristic of which is within a predetermined range of physical characteristics, to containers. The plurality of buckets receives each of the dispensed items, the measured physical characteristic of which is greater than or less than the predetermined range of physical characteristics.

A method of dispensing items comprises the steps of dispensing items from a dispenser, measuring a physical characteristic of each of the dispensed items, directing each of the dispensed items the measured physical characteristic of which is within a predetermined range of physical characteristics to a container chute, and diverting each of the dispensed items the measured physical characteristic of which is greater than or less than the predetermined range of physical characteristics to a bucket.

In still yet another embodiment of the present invention, a dispensing system comprises a dispenser for receiving and dispensing items. The dispenser comprises a plurality of dispensing paths, at least one rotation drive for rotating the plurality of dispensing paths, and at least one vibration device for vibrating the plurality of dispensing paths, such that the plurality of dispensing paths dispenses the items singularly the dispensing system also comprises at least one sensing unit for measuring a physical characteristic of each of the singularly-dispensed items, and a plurality of container chutes for directing each of the singularly-dispensed items, the measured physical characteristic of which is within a predetermined range of physical characteristics, to containers. Moreover, the dispensing system comprises a plurality of diversion chutes for diverting each of the singularly-dispensed items, the measured physical characteristic of which is greater than or less than the predetermined range of physical characteristics, away from the containers.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

The invention may be understood more readily by reference to the following drawings.

DETAILED DESCRIPTION OF PREFERRED EMBODIMENTS

Figure 1:
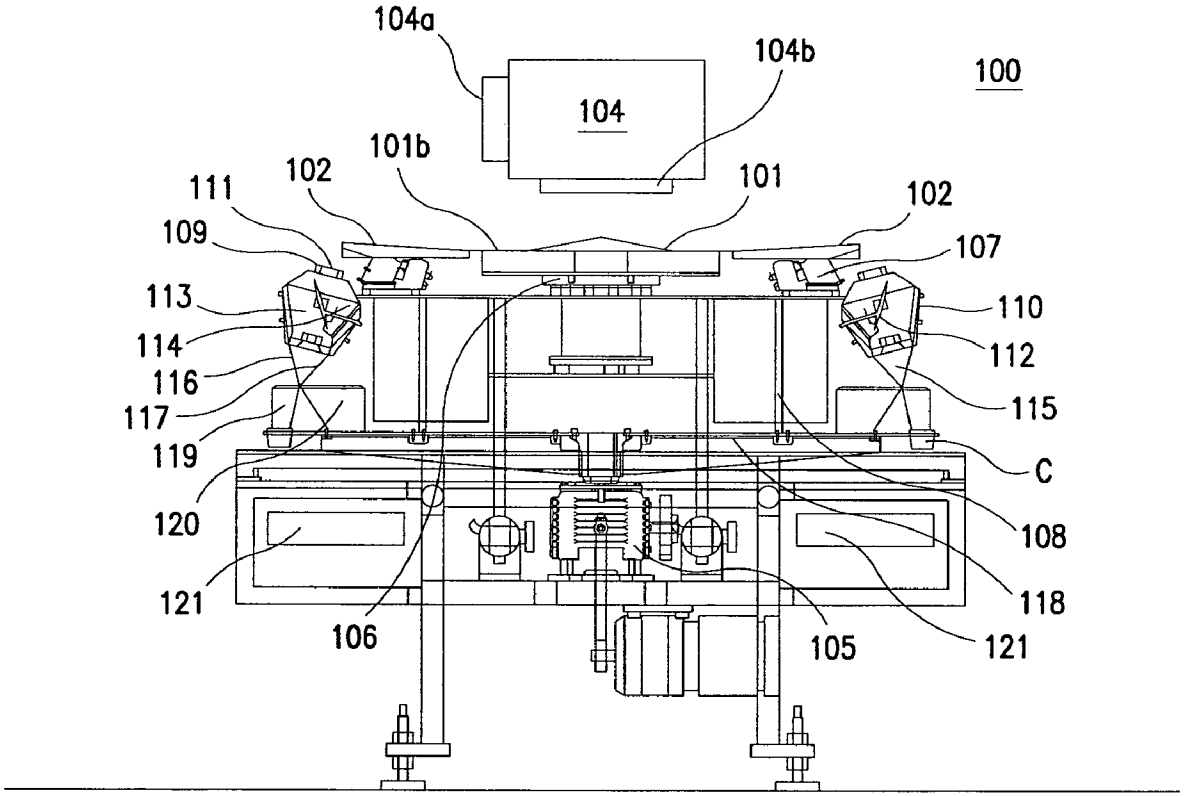
FIG. 1 shows a cross-sectional view of a dispensing and diversion system according to an embodiment of the present invention.
Figure 2:
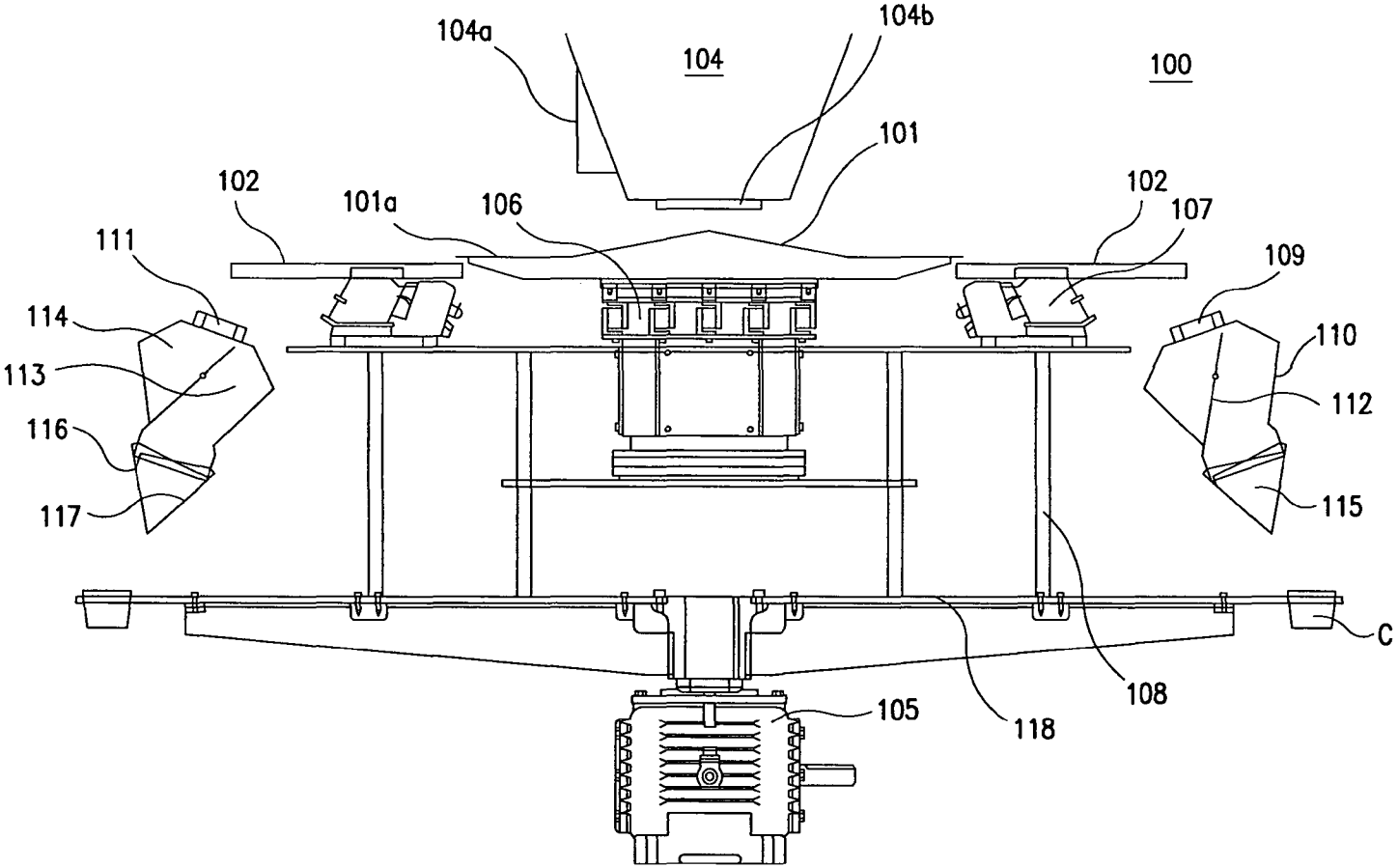
FIG. 2 shows a cross-sectional view of a rotary, vibratory dispenser of the dispensing and diversion system of the present invention.

FIGS. 1 and 2 show a dispensing system according to an embodiment of the present invention. The dispensing system 100 may include a dispenser for receiving and dispensing a plurality of items, sensing units for measuring a physical characteristic of each of the dispensed items, dispensing heads for receiving each of the dispensed items, for directing predetermined quantities of items, the measured physical characteristic of which is within a predetermined range of physical characteristics, to containers, and for diverting items, the measured physical characteristic of which is greater than or less than the predetermined range of physical characteristics away from a container, a star wheel for positioning containers to receive the predetermined quantities of items, container chutes for directing the dispensed items to containers, and diversion chutes for diverting items away from containers.

As shown in FIGS. 1 and 2, dispenser may include a rotary, vibratory dispenser. Rotary, vibratory dispenser, may include a feeder bowl 101 and a plurality of dispensing paths 102 positioned around feeder bowl 101. The shape and configuration of feeder bowl 101 may vary, depending upon a physical characteristic, e.g., a weight, a volume, a density, a temperature, a friction coefficient of a surface, or the like, of items to be dispensed. Feeder bowl 101 may be dome-shaped, hemispherical-shaped, conical-shaped, substantially-planar, or the like. Moreover, feeder bowl 101 may include a substantially planar peripheral edge 101*a*. FIGS. 1 and 2 show an embodiment of feeder bowl 101 with an attenuated conical shape and a substantially planar peripheral edge 101*a*. Feeder bowl 101 may include a substantially smooth item-receiving surface or a textured item-receiving surface, depending upon a physical characteristic, e.g., a weight, a volume, a density, a temperature, a friction coefficient of a surface of an item, or the like, of items to be dispensed.

Figure 9:
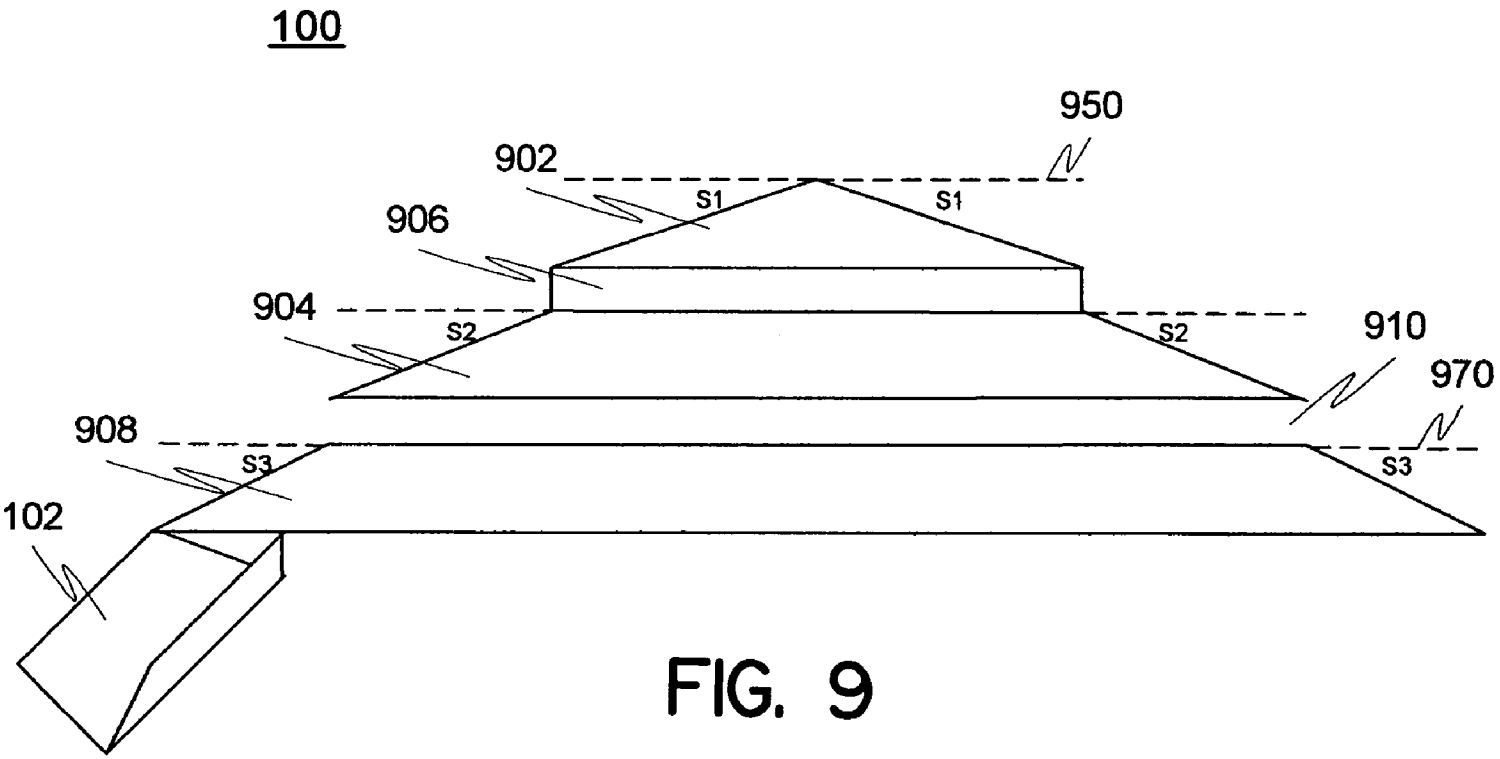
FIG. 9 shows a cross-sectional view of a feeder bowl according to an embodiment of the present invention.

FIG. 9 shows another embodiment of feeder bowl 101. In this embodiment, feeder bowl 101 may comprise a plurality of sloped portions, and each of the sloped portions may be separated by a substantially cylindrical portion. For example, feeder bowl 101 may comprise a first sloped portion 902 and a second sloped portion 904 connected to first sloped portion 902 via a substantially cylindrical portion 906. Cylindrical portion 906 may form a vertical drop between first sloped portion 902 and second sloped portion 904. In an embodiment, a thickness of cylindrical portion 906 may be selected, such that a distance between first sloped portion 902 and second sloped portion 904 is about 25.4 mm (about 1 inch). Moreover, first sloped portion 902, second sloped portion 904, and substantially cylindrical portion 906 may be stationary portions, i.e., non-rotating portions, or vibratory portions, or both. First sloped portion 902 and second sloped portion 904 may gradually accelerate the fall of items dispensed by bulk delivery apparatus 106 to feeder bowl 101. Specifically, a slope S1 of second sloped portion 904 may be greater than a slope S2 of first sloped portion 902, such that an item's speed increases between first sloped portion 902 and second sloped portion 904. In a preferred embodiment, first sloped portion 902 may be inclined in a downward direction relative to a first horizontal plane 950, and slope S1 of first sloped portion 902 may be about 9.5° relative to first horizontal plane 950. Moreover, second sloped portion 904 may be inclined in a downward direction relative to a second horizontal plane 960 which is parallel to first horizontal plane 950, and slope S2 of second sloped portion 904 may be about 12° relative to second horizontal plane 960. This preferred embodiment achieved superior performance with most items tested. Nevertheless, in yet another embodiment, slope S1 of first sloped portion 902 and slope S2 of second sloped portion 904 may be varied, depending on the type of item dispensed from bulk delivery apparatus 106.

Feeder bowl 101 also may comprise a sloped member 908 fixed to dispensing paths 102, such that sloped member 908 may rotate with dispensing paths 102. Sloped member 908 may be separate from second sloped portion 904, such that a gap 910 is formed between second sloped portion 904 and sloped member 908. In an embodiment, sloped member 908 may be inclined in a downward direction relative to a third horizontal plane 970 which is parallel to second horizontal plane 960. In operation, items fall from second sloped portion 904 onto the surface of sloped member 908 and, subsequently may become airborne. A slope S3 of sloped member 908 relative to third horizontal plane 970 may be selected to reduce the amplitude of the airborne items. For example, slope S3 of sloped portion 908 may be between about 1° and about 15°, and in a preferred embodiment, slope S3 of sloped portion 908 is about 15°. Moreover, dispensing paths 102 may be inclined in a downward direction, such that a slope of dispensing paths 102 is about the same as slope S3 of sloped member 908. Although in FIG. 9 sloped member 908 is depicted as a single portion member, sloped member may be divided into a plurality of sloped portions having varying slopes, such as described above with respect to first sloped portion 902, second sloped portion 904, and substantially cylindrical portion 906.

Figure 3:
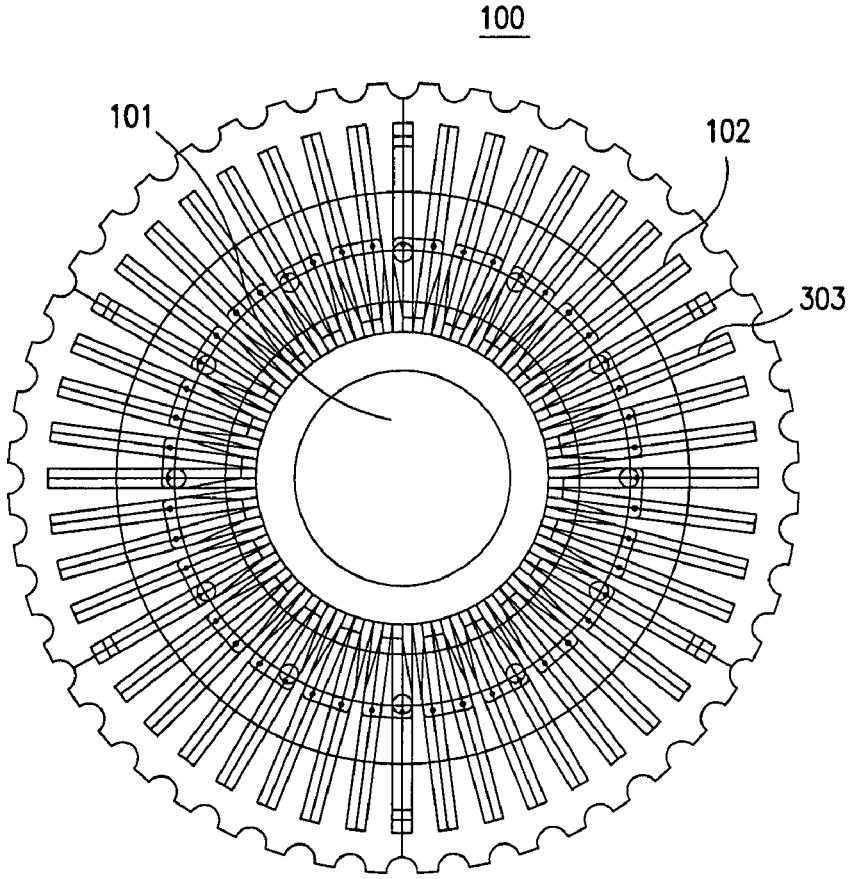
FIG. 3 is a cutaway, plan view of a rotary, vibratory dispenser of the dispensing and diversion system according to an embodiment of the invention.
Figure 4:
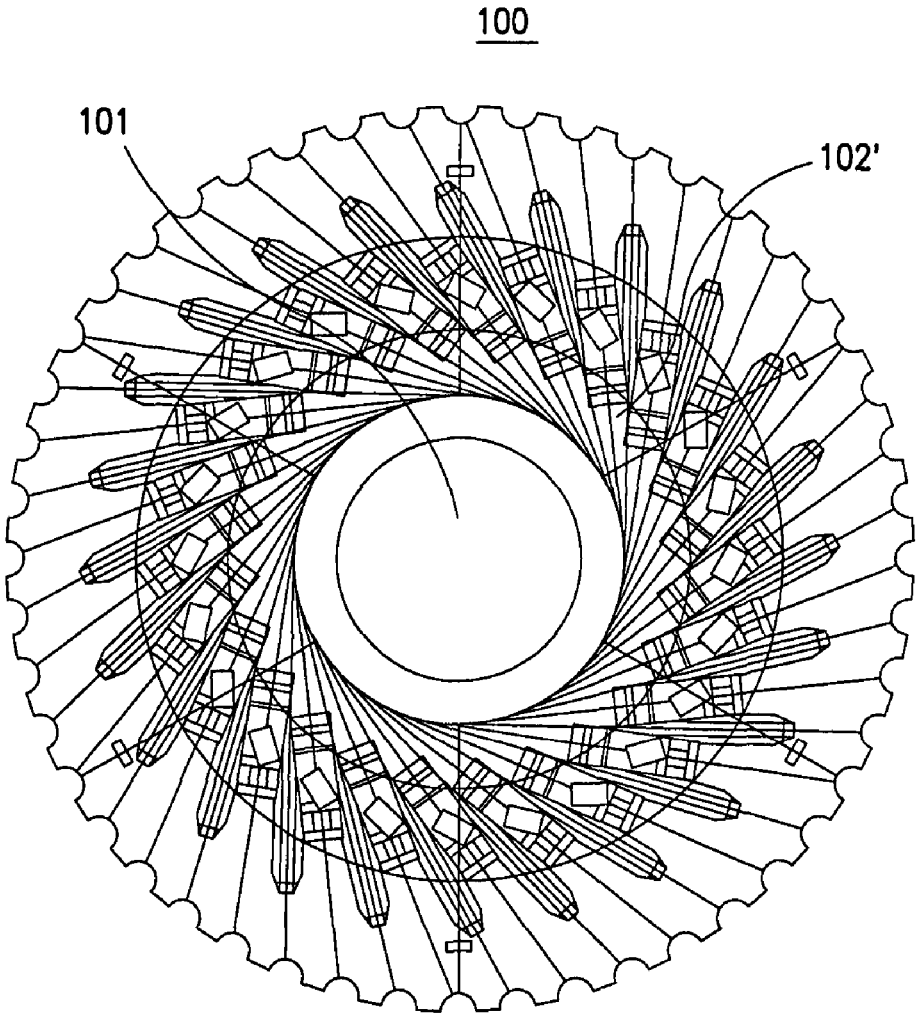
FIG. 4 is a cutaway, plan view of a rotary, vibratory dispenser of the dispensing and diversion system according to an alternate embodiment of the invention.

Referring again to FIGS. 1 and 2, dispensing paths 102 may be positioned around feeder bowl 101 to receive items supplied by feeder bowl 101. Moreover, dispensing paths 102 may be positioned around feeder bowl 101 in a variety of configurations. As shown in FIG. 3, dispensing paths 102 may be positioned around a periphery of feeder bowl 101 and may extend radially from feeder bowl 101. As shown in FIG. 4, dispensing paths 102' may be positioned around a periphery of feeder bowl 101 and extend in an arc-shaped pattern from feeder bowl 101 in a direction that may be opposite to a direction of rotation of feeder bowl 101. The number of dispensing paths may vary. For example, forty-eight (48) dispensing paths 102, 102' may be positioned around feeder bowl 101, as shown in FIGS. 3 and 4. According to another embodiment of the invention, approximately one hundred (100) dispensing paths 102, 102' may be positioned around feeder bowl 101. In a further embodiment of the invention, twelve (12) dispensing paths 102, 102' may be positioned around feeder bowl 101. However, any number of dispensing paths 102, 102' may be positioned around feeder bowl 101.

Moreover, each dispensing path 102 may comprise one or more channels, each of which channels may dispense items singularly. For example, each dispensing path 102 may comprise a single channel 303, as shown in FIG. 3. However, each dispensing path may comprise a pair of channels, three channels, four channels, or more.

A bulk delivery apparatus 104 may be used to deliver items to rotary, vibratory dispenser. Bulk delivery apparatus 104 may be positioned adjacent to rotary, vibratory dispenser, as shown in FIG. 1, to deliver items to rotary, vibratory dispenser, e.g., to feeder bowl 101 of rotary, vibratory dispenser. Bulk delivery apparatus 104 may include a bulk delivery drive 104*a*, e.g., a vibration device, a motor, or the like, for controlling a rate of delivery of items from bulk delivery apparatus 104 to rotary, vibratory dispenser. Adjustment of bulk delivery drive 104*a* enables adjustment of the rate of delivery of items from bulk delivery apparatus 104.

As shown in FIG. 1, bulk delivery apparatus 104 may comprise a hopper 104 and bulk delivery drive 104*a* may comprise a hopper vibration device 104*a* for vibrating hopper 104, so that hopper 104 may deliver items at different rates to feeder bowl 101. Such hopper vibration devices 104*a* may include Syntron® Electromagnetic Vibrators, which are available from FMC Technologies Material Handling Solutions of Homer City, Pa. Other hoppers 104 and hopper vibration devices 104*a* may include the Skako Comassa Feeders, which are available from Skako, Inc. of Faaborg, Denmark.

In another embodiment of the invention, bulk delivery apparatus 104 may include a conveyor or the like for delivering items to feeder bowl 101 of rotary, vibratory dispenser. In a further embodiment of the invention, the rate of delivery of items from bulk delivery apparatus 104 to rotary, vibratory dispenser may be regulated by adjusting an aperture, or the like, of bulk delivery apparatus 104.

Rotary, vibratory dispenser may include a feeder bowl rotation drive 105, a feeder bowl vibration device 106, and one or more dispensing path vibration devices 107. Feeder bowl rotation drive 105 may rotate feeder bowl 101 at different rotational speeds, which may correspond to a desired rate at which packages, e.g., containers, or the like, are to be transported to dispenser 100. For example, if rotary, vibratory dispenser includes 48 dispensing paths 102 and each dispensing path 102 includes two item-dispensing channels, and rotary, vibratory dispenser 100 must fill 480 containers per minute, feeder bowl rotation drive 105 may rotate feeder bowl 101 and dispensing paths 102 at five (5) revolutions per minute (rpm), so that rotary, vibratory dispenser may dispense items to 480 containers per minute. If each dispensing path 102 includes a single item-dispensing channel, rotation drive 105 may rotate feeder bowl 101 and dispensing paths 102 at ten (10) ten rpm, so that rotary, vibratory dispenser may dispense items to 480 containers per minute.

In one embodiment of the invention, feeder bowl rotation drive 105 may rotate dispensing paths 102 in synchronization with feeder bowl 101, e.g., at a substantially similar rotational speed as feeder bowl 101. For example, feeder bowl rotation drive 105 may rotate a frame 108, which supports feeder bowl 101 and dispensing paths 102. According to another embodiment of the present invention, feeder bowl rotation drive 105 may rotate dispensing paths 102 at a rotational speed that is greater than or less than a rotational speed at which feeder bowl rotation drive 105 rotates feeder bowl 101. For example, feeder bowl rotation drive 105 may rotate dispensing paths 102 at different relative rotational speeds, e.g., via a transmission (not shown), or the like, so that a rotational speed of dispensing paths 102 may be varied relative to a rotational speed of feeder bowl 101. In a still further embodiment of the invention, feeder bowl rotation drive 105 may rotate dispensing paths 102 in a direction of rotation that is opposite to a direction of rotation of feeder bowl 101.

Feeder bowl vibration device 106 may vibrate feeder bowl 101 at different vibrational settings, e.g., at different vibrational magnitudes, at different vibrational frequencies, in different vibrational planes, or combinations thereof, so that feeder bowl 101 may supply items uniformly to each dispensing path 102. Feeder bowl vibration device 106 may vibrate feeder bowl 101 at vibrational magnitudes and at vibrational frequencies that are proportionate to a physical characteristic, e.g., a density, a volume, a weight, a temperature, or the like, of items to be supplied by feeder bowl 101 to dispensing paths 102. Such feeder bowl vibration devices 106 may include Syntron® Electromagnetic Vibrators, available from FMC Technologies Material Handling Solutions of Homer City, Pa.

Feeder bowl vibration device 106 may vibrate feeder bowl 101 at different vibrational magnitudes, different vibrational frequencies, or both, in a first plane, in a second plane, or in a first plane and a second plane. First plane may be generally transverse to second plane. In particular, first plane may be a substantially horizontal plane, while second plane may be a substantially vertical plane. Feeder bowl vibration device 106 may vibrate feeder bowl 101 at vibrational settings that correspond to one or more of a rate of delivery of items to feeder bowl 101, a rotational speed of feeder bowl 101, or a desired rate of supplying items from feeder bowl 101 to dispensing paths 102. Feeder bowl vibrational settings may be adjusted, as necessary, so that feeder bowl 101 may receive a plurality of items, e.g., from a bulk delivery apparatus 104 or the like, and supply items uniformly to each dispensing path 102.

A dispensing path vibration device 107 may vibrate each dispensing path 102 and associated item-dispensing channel. Each dispensing path vibration device 107 may vibrate each dispensing path 102 at different vibrational settings, e.g., at different vibrational frequencies, at different vibrational magnitudes, in different vibrational planes, or combinations thereof, so that each dispensing path 102 may dispense items singularly. Moreover, each dispensing path vibration device 107 may vibrate each dispensing path 102 at different vibrational settings in a first plane, in a second plane, or in a first plane and a second plane, so that each dispensing path 102 may dispense items singularly. First plane may be generally transverse to second plane. In particular, first plane may be substantially horizontal, while second plane may be substantially vertical. Such dispensing path vibration devices 107 may include Syntron® Solid Mount Linear Drives, which are available from FMC Technologies Material Handling Solutions of Homer City, Pa.

Each dispensing path vibration device 107 may vibrate one or more respective dispensing paths 102 proportionately to a physical characteristic e.g., a density, a volume, a weight, a temperature, or the like, of each item to be dispensed. Moreover, each dispensing path vibration device 107 may vibrate each dispensing path 102 proportionately to one or more of a rate of supply of items from feeder bowl 101 to each dispensing path 102, a rotational speed of dispensing paths 102, or a desired dispensing rate of items from each dispensing path 102.

A sensing unit may be positioned at each dispensing path 102, e.g., adjacent to a distal end of each dispensing path 102 and its associated item-dispensing channel(s). If a dispensing path 102 comprises more than one item-dispensing channel a sensing unit may be positioned at each channel, e.g., at a distal end of each channel of a dispensing path 102. In one embodiment of the invention, a sensing unit 109 may be positioned at a dispensing head 110. For example, a sensing unit 109 may be positioned adjacent to an opening of each dispensing head 110, as shown in FIGS. 1 and 2.

Sensing units 109 may measure a physical characteristic, e.g., a volume, a weight, a density, or the like, of each item dispensed from a dispensing path 102 or item-dispensing channel. Each sensing unit 109 transmits each measurement to a control unit, which determines whether the measurement is within a predetermined range of physical characteristics for a particular item. For example, each sensing unit 109 may comprise an optic sensor that may measure a volume of each item dispensed from a dispensing path 102 or item-dispensing channel and transmit each measurement to control unit. Control unit may compare each measurement to a predetermined range of volumes for that particular item to determine whether the measured volume of each item is within the predetermined range of volumes, or whether the measured volume for an item is greater than or less than the predetermined range of volumes for the item.

By measuring a physical characteristic of each dispensed item and transmitting each measurement to a control unit, sensing units 109 enable identification of items, the measured physical characteristic of which is greater than or less than a predetermined range of physical characteristics for the item. In this way, sensing units 109 may identify out-of-specification items, i.e., items the measured physical characteristic of which is greater than or less than a predetermined range of physical characteristics.

In addition to determining whether a measured physical characteristic of each item is within a predetermined range of physical characteristics, control unit may count items dispensed from each dispensing path 102 or channel. For example, control unit may count each item, the measured physical characteristic of which is within a predetermined range of physical characteristics. Control unit may identify each item, the measured physical characteristic of which is greater than or less than the predetermined range of physical characteristics, so that each item, the measured physical characteristic of which is greater than or less than a predetermined range, may not be counted.

Based on this measured count, control unit may activate each dispensing head 110 to direct predetermined quantities of items, the measured physical characteristic of each of which items is within a predetermined range of physical characteristics, to a container. Control unit may activate each dispensing head 110 to divert items, the measured physical characteristic of which is greater than or less than a predetermined range of physical characteristics, away from a container. Moreover, control unit may activate each dispensing head 110 to divert quantities of items in which at least one item has a measured physical characteristic that is greater than or less than a predetermined range of physical characteristics away from containers. In this way, control unit enables containers to be filled with predetermined quantities of items, the measured physical characteristic of each of which is within a predetermined range of physical characteristics. Control unit ensures that dispensing heads 110 may divert away from containers each item the measured physical characteristic of which is greater than or less than a predetermined range of physical characteristics.

As shown in FIGS. 1 and 2, a dispensing head 110 may be positioned at each dispensing path 102 and associated item-dispensing channel to receive items dispensed from each dispensing path 102 and channel. For example, a dispensing head 110 may be positioned adjacent to each dispensing path 102, e.g., adjacent to a distal end of each dispensing path 102 and associated item-dispensing channel(s). In embodiments of the invention in which each dispensing path 102 may include more than one item-dispensing channel, a dispensing head 110 may be positioned adjacent to each channel, e.g., at a distal end of each channel of a dispensing path 102.

Figure 5:
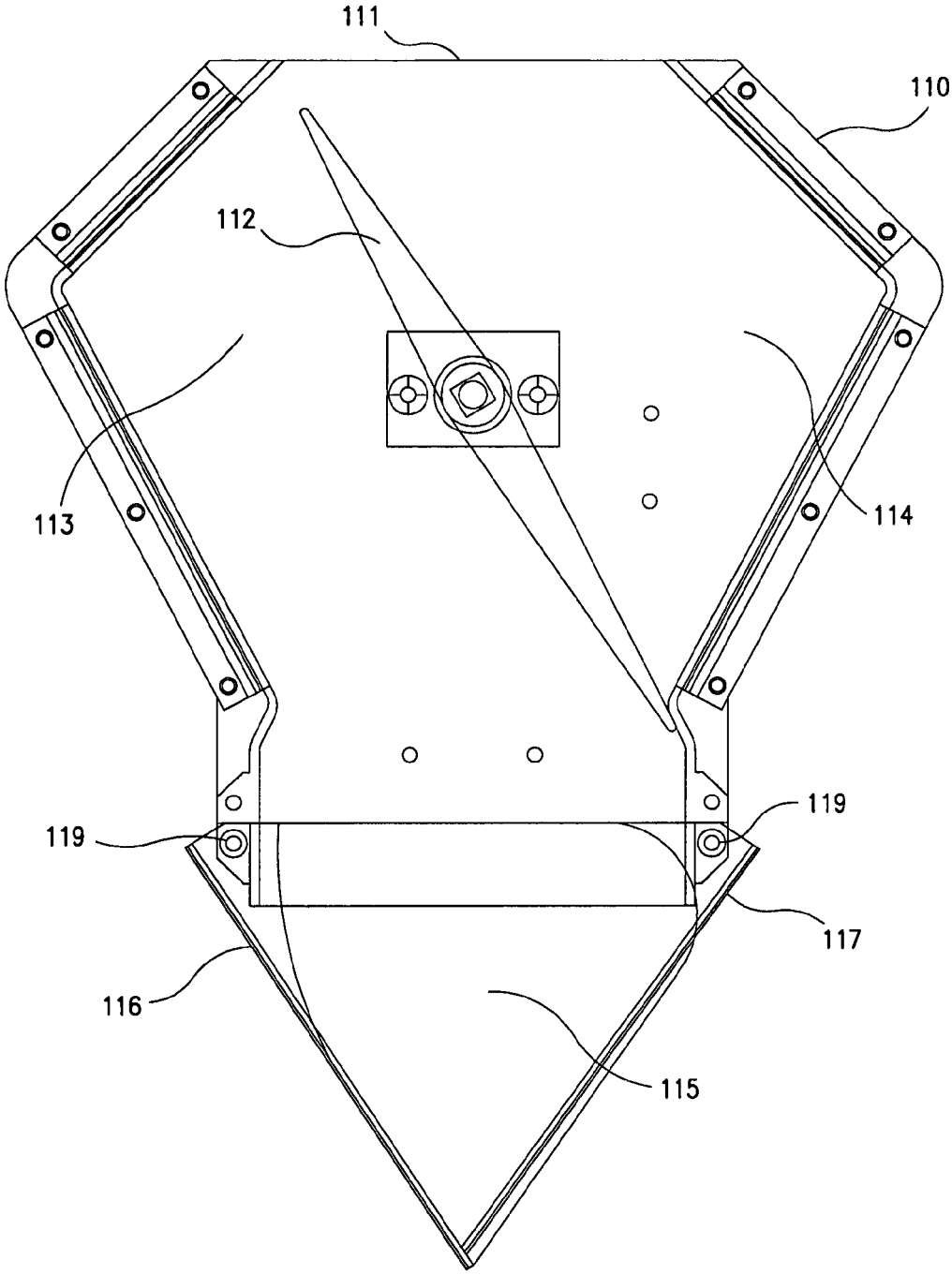
FIG. 5 shows a cross-sectional view of a dispensing head according to an embodiment of the present invention.

As shown in FIGS. 1, 2, and 5, each dispensing head 110 may include an opening 111 for receiving items dispensed from each dispensing path 102 or channel, a bifurcation device 112, a first chamber 113, a second chamber 114, and a holding chamber 115. Control unit may activate bifurcation device 112 to directs dispensed items received in dispensing head 110 to first chamber 113 or second chamber 114.

FIG. 5 shows a dispensing head 110 in which bifurcation device 112 is positioned to direct items to second chamber 514. Bifurcation device 112 may be positioned to direct items to first chamber 113. Moreover, bifurcation device 112 may remain in this position until a predetermined quantity of items is received in first chamber 113. Bifurcation device 112 then may be repositioned to direct items to second chamber 114 and to allow items in first chamber 113 to flow toward holding chamber 115. After a predetermined quantity of items is received in second chamber 114, bifurcation device 112 may be repositioned to direct items to first chamber 113 and to allow items in second chamber 114 to flow toward holding chamber 115.

Holding chamber 115 may be positioned at a lower portion of each dispensing head 110 to receive items from first chamber 113 or second chamber 114. In one embodiment of the present invention, holding chamber 115 may include a pair of doors 116, 117. Each door 116, 117 of holding chamber 115 may be activated to direct items from dispensing head 110 in a first direction, which may be toward a container or a container chute 119. Each door 116, 117 may be activated to divert items in a second direction, which may be away from a container and toward a diversion chute 120.

To direct items in a first direction, each door 116, 117 may rotate in a clockwise direction, e.g., about a pivot 119 shown in FIG. 5; however, one door 116 may rotate through a greater angle of displacement than the other door 117, so that an aperture forms between distal ends of doors 116, 117. Items retained by holding chamber 115 may flow along an inner surface of door 117 and through the aperture in a first direction. To direct items in a second direction, each door 116, 117 may rotate in a counter-clockwise direction, e.g., about a pivot 119, shown in FIG. 5; however, one door 117 may rotate through a greater angle of displacement than the other door 116, so that an aperture forms between distal ends of doors 116, 117. Items retained by doors 116, 117 of holding chamber 115 may flow along an inner surface of the other door 116 and through the aperture in a second direction. Each door 116, 117 may have a substantially planar surface or a curved surface to direct or divert items.

Referring to FIGS. 7*a*–7*h*, in a modification of this embodiment of the present invention, holding chamber 115 may be replaced by a first holding chamber 115' and a second holding chamber 115", door 117 may be replaced by a first door 117', and door 116 may be replaced by a guide wall 116' and a second door 116". First holding chamber 115' may be positioned below second holding chamber 115", and when second door 116" is in a closed position, holding chambers 115' and 115" may form a continuous chamber. Nevertheless, when second door 116" is in an open position, second door 116" may prevent the items from reaching first holding chamber 116'. Specifically, bifurcation device 112 may receive the items which pass through opening 111, such that the items are positioned within first chamber 113 or second chamber 114. When bifurcation device 112 receives a predetermined number of items which have acceptable physical characteristics, e.g., physical characteristics which are within a predetermined range of physical characteristics, bifurcation device 112 may direct the received items into first holding chamber 115' via second holding chamber 115". First door 117' then may move from a closed positioned to an open position, such that the items received by first holding chamber 115' are directed toward the container. Nevertheless, if bifurcation device 112 receives any item which does not have acceptable characteristics, e.g., physical characteristics which are greater than or less than the predetermined range of physical characteristics, second door 116" may move from the closed position to the open position, and bifurcation device 112 subsequently may direct the received items into second holding chamber 115". When bifurcation device 112 directs the received items into second holding chamber 115", bifurcation device 112 may receive new items, such that the new items may be positioned within first chamber 113 or second chamber 114. Moreover, when the received items reach second holding chamber 115", second door 116" may direct the received items away from the container. Consequently, when bifurcation device 112 receives an unacceptable item, each of the items received by the bifurcation device 112 may be directed away from the container without having to wait for bifurcation device 112 to receive the predetermined number of items. Moreover, the new items may be received by bifurcation device 112 without having to wait for second door 116" to direct the received items away from the container.

In an another embodiment of the present invention, holding chamber 115 may include two pairs of reconfigurable doors (not shown). One pair of doors may be positioned beneath first chamber, while a second pair of reconfigurable doors may be positioned beneath second chamber. The first pair of reconfigurable doors may receive items from first chamber 113, while the second pair of reconfigurable doors may receive items from second chamber 114. Each pair of doors may be activated to direct items in a first direction, e.g., toward a container, or to divert items in a second direction, e.g., away from a container.

Figure 6:
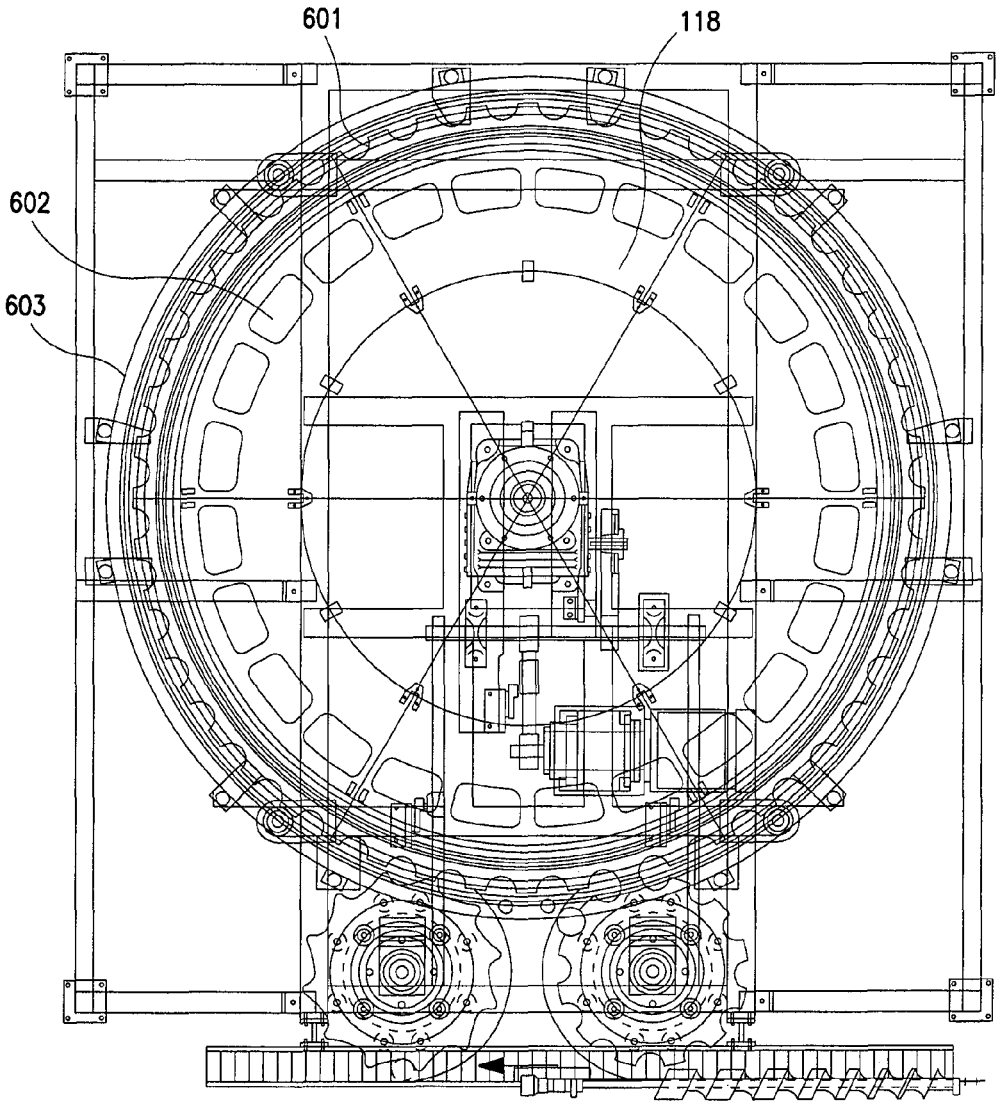
FIG. 6 shows a cutaway, plan view of a star wheel for use with the dispensing and diversion system of the present invention.
Figure 7A:
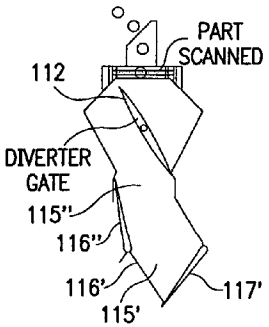
FIGS. 7*a*–7*h* show an operation of a dispensing head according to another embodiment of the present invention.
Figure 7B:
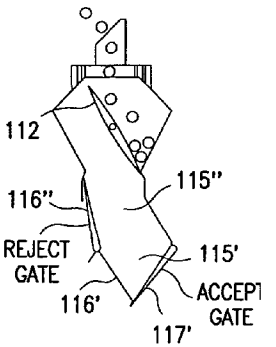
Figure 7C:
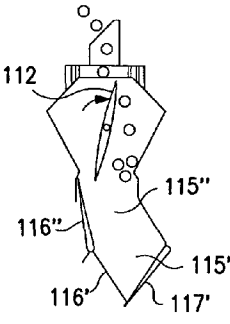
Figure 7D:
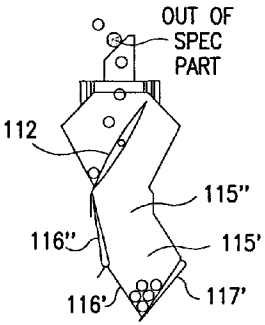
Figure 7E:
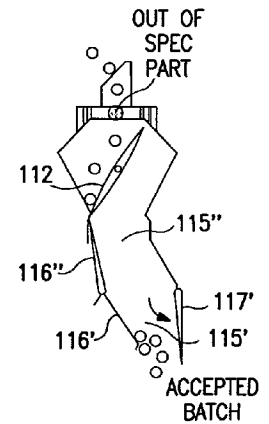
Figure 7F:
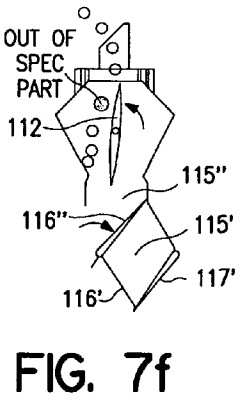
Figure 7G:
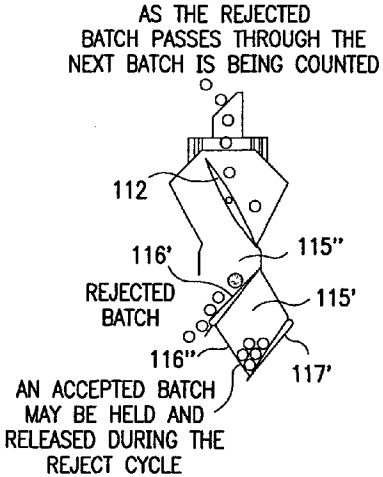
Figure 7H:
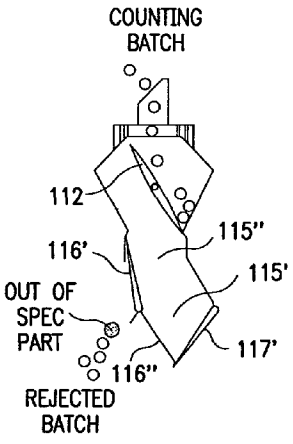

A dispensing and diversion system of the present invention may include a star wheel 118. As shown in FIG. 6, star wheel 118 may include a plurality of container-receiving grooves 601 and a plurality of apertures 602. Each container-receiving groove 601 is adapted to receive a container C, so that star wheel 118 may transport a plurality of containers in synchronization with rotary, vibratory dispenser, e.g., at a substantially similar rotational speed as dispensing heads 110 of rotary, vibratory dispenser, in alignment with a respective dispensing head 110 of rotary, vibratory dispenser, or the like. Container-receiving grooves 601 may be positioned along a periphery of star wheel 118. Each container-receiving groove 601 is adapted to position a container in alignment with a respective dispensing path or dispensing head to receive a predetermined quantity of items. Moreover, container-receiving grooves 601 of varying dimension and shape may be mounted interchangeably to star wheel 118, so that star wheel 118 may receive and position containers of varying size and shape at different positions relative to dispensing paths 102 and dispensing heads 110.

Star wheel 118 may be driven directly by feeder bowl rotation drive 105. For example, feeder bowl rotation drive 105 may drive a frame 108 which supports star wheel 118 and feeder bowl 101. In an alternate embodiment, star wheel 118 may be driven indirectly by feeder bowl rotation drive 105, e.g., via a transmission. In a further embodiment, a separate drive may drive star wheel 118 at different rotational speeds, so that star wheel 118 may position containers in synchronization with rotary, vibratory dispenser.

A plurality of apertures 602 may be formed through star wheel 118. Each aperture 602 may extend from a top surface of star wheel 118 to a bottom surface of star wheel 118, so that items may pass through star wheel 118, via apertures 602. The number, shape, and position of star wheel apertures 602 may vary according to the number of dispensing heads 110 of rotary, vibratory dispenser, a physical characteristic of each dispensed item, a configuration of one or more chutes positioned in alignment with apertures 602, or the like.

A guard rail 603 may be positioned adjacent to star wheel 118. For example, a guard rail 603 may be positioned adjacent to a periphery of star wheel 118, as shown in FIG. 6. Guard rail 603 may be positioned in relation to star wheel 118, so that guard rail 603 retains each of a plurality of containers in engagement with a respective container-receiving groove 601. Moreover, guard rails 603 of varying dimension and shape may be positioned interchangeably around star wheel 118, depending upon the dimension and shape of containers to be received by star wheel 118.

As shown in FIG. 1, one or more container chutes 119 may be positioned on star wheel 118. Container chutes 119 may be positioned on star wheel 118 in alignment with a respective dispensing path 102 or dispensing head 110 or both, so that container chutes 119 may receive predetermined quantities of items directed from respective dispensing heads 110. Container chutes 119 may be positioned around a periphery of star wheel 118. Each container chute 119 may be configured to direct items to a container C positioned at a respective container-receiving groove 601, as each container is transported by star wheel 118 in synchronization with dispenser.

The number, shape, and position of container chutes 119 may vary depending upon the number and configuration of dispensing heads 110 of rotary, vibratory dispenser, the number and configuration of container-receiving grooves of star wheel 118, or the like. Moreover, container chutes 119 of varying size and dimension may be positioned interchangeably on star wheel 118 to direct items of varying physical characteristics, e.g., volume, weight, density, or the like, to containers positioned around star wheel 118. In another embodiment of the invention (not shown), container chutes 119 may be positioned adjacent to star wheel 118 to receive items from dispensing paths 102 or dispensing heads 110 and to deliver the items to a respective container. For example, container chutes 119 may be supported by a respective dispensing head 110 or a frame 108, or the like, rather than being positioned on star wheel 118.

One or more diversion chutes 120 may be positioned on star wheel 118. Diversion chutes 120 may be positioned around a periphery of star wheel 118, e.g., adjacent to container chutes 119, to receive items diverted by one or more dispensing heads 110. Moreover, each diversion chute 120 may communicate with an aperture 602 of star wheel 118, so that each diversion chute 120 may divert items through a respective star wheel aperture 602 and away from containers positioned at container-receiving grooves 601 of star wheel 118. Star wheel 118 may position each diversion chute 120 in alignment with one or more dispensing heads 110.

The number, shape, and position of diversion chutes 120 may vary depending upon the number and configuration of dispensing heads 110 of rotary, vibratory dispenser, the number and configuration of star wheel apertures 602, or the like. Each diversion chute 120 may communicate with, i.e., divert items through, one or more star wheel apertures 602. Moreover, diversion chutes 120 of varying size and dimension may be positioned interchangeably on star wheel 118 to divert items of varying physical characteristics, e.g., volume, weight, density, or the like, away from containers positioned around star wheel 118. For example, diversion chutes 120 may be formed by concentric walls extending from a surface of star wheel 118 to form an annular space over star wheel apertures 602. In another embodiment of the invention, diversion chutes 120 may be positioned adjacent to star wheel 118 to receive items diverted by respective dispensing heads 110. For example, diversion chutes 120 may be supported by a frame or by a respective dispensing head 110, rather than being supported by star wheel 118.

The dispensing and diversion system of the present invention may include a rejection system. The rejection system may include a rejection conveyor 121, as shown in FIG. 1, and a rejection bin. The rejection conveyor 121 may be positioned beneath star wheel 118 to receive items diverted by diversion chutes 120 through star wheel apertures 602. Rejection conveyor 121 may include one or more conveying components that receive items diverted by diversion chutes. Rejection conveyor 121 may transport diverted items to a rejection bin, where diverted items may be collected. Suitable rejection conveyors 121 include conveyors powered by one or more drives to transport diverted items to a rejection bin and static conveyors, such as chutes, that receive items diverted through star wheel and guide items to a rejection bin.

According to another embodiment of the invention, each dispensing head 110 may divert items through star wheel apertures 602*a* to a plurality of buckets (not shown) that may be positioned beneath star wheel 118 to rotate with star wheel 118 and to receive items diverted through star wheel apertures 602. For example, a bucket may be positioned beneath one or more star wheel apertures 602 to receive items diverted through each aperture 602. Moreover, each bucket may include a cam follower that engages a cam track as each bucket rotates with star wheel 118. The cam track may be positioned adjacent to star wheel 118 and may comprise at least one cam. Engagement of the cam follower of each bucket and the at least one cam of the cam track causes each bucket to discharge the diverted items from each bucket to a rejection system, e.g., to a rejection conveyor, to a rejection chute, or the like. For example, each bucket may be mounted pivotally beneath star wheel 118, such that engagement of the cam follower of each bucket and the at least one cam of the cam track may pivot each bucket to discharge diverted items contained within each bucket to a rejection system. Moreover, the at least one cam may comprise a plurality of cams positioned along the cam track, so that each of the buckets may discharge diverted items at a plurality of locations.

The rejection system may transport the diverted items discharged by each bucket to a rejection bin, where the items may be collected. The rejection system may comprise a conveyor, a chute, or the like to transport diverted items to the rejection bin.

In operation, rotary, vibratory dispenser receives a plurality of items delivered by bulk delivery apparatus 104 to feeder bowl 101. Feeder bowl rotation drive 105 and feeder bowl vibration device 106 respectively rotate and vibrate feeder bowl 101, so that feeder bowl 101 supplies items uniformly to each of a plurality of dispensing paths 102 positioned around feeder bowl 101. Dispensing path vibration devices 107 vibrate each dispensing path 102 and associated item-dispensing channel(s), so that each dispensing path 102 and channel(s) may dispense items singularly.

Sensing units 109 measure a physical characteristic of each item dispensed from each dispensing path 102 or channel and transmit each measurement to a control unit. Control unit determines whether the measured physical characteristic of each item is within a predetermined range of physical characteristics for that item, or whether the measured physical characteristic of an item is greater than or less than the predetermined range of physical characteristics. Control unit counts each dispensed item to provide an exact count of items dispensed from each dispensing path 102 and channel. In one embodiment of the invention, control unit counts only items, the measured physical characteristic of which is within a predetermined range of physical characteristics.

A dispensing head 110 receives items dispensed from each respective dispensing path 102 and channel. Bifurcation device 112 directs items to one of a first chamber 113 or a second chamber 114 of dispensing head 110. Control unit activates bifurcation device 112 once a predetermined quantity of items is received within a respective chamber of dispensing head 110, so that the items may exit the chamber and flow to holding chambers 115. If any of the items in a predetermined quantity of items has a measured physical characteristic of which that is greater than or less than a predetermined range, control unit activates the holding chamber 115 of the respective dispensing head 110 to divert the items away from a container and toward a diversion chute 120, so that the items may pass through diversion chute 120 and star wheel 118 to a rejection conveyor. Rejection conveyor transports the items to a rejection bin. If each of the items in the predetermined quantity of items has a measured physical characteristic that is within a predetermined range of physical characteristics, control unit activates holding chamber 115 of dispensing head 110 to direct the predetermined quantity of items to a container chute 119, so that items may pass through container chute 119 to a container positioned at a container-receiving groove 601 of star wheel 118.

Control unit may activate bifurcation device 112 to release items in a chamber as soon as an item with a measured physical characteristic that is greater than or less than a predetermined range is received in dispensing head 110. In another embodiment of the invention, control unit may increment a count of a predetermined quantity of items for each item the measured physical characteristic of which is greater than or less than a predetermined range, so that dispensing head 110 may direct a predetermined quantity of items, the measured physical characteristic of which of which is within a predetermined range of physical characteristics, to a container.

Figure 8:
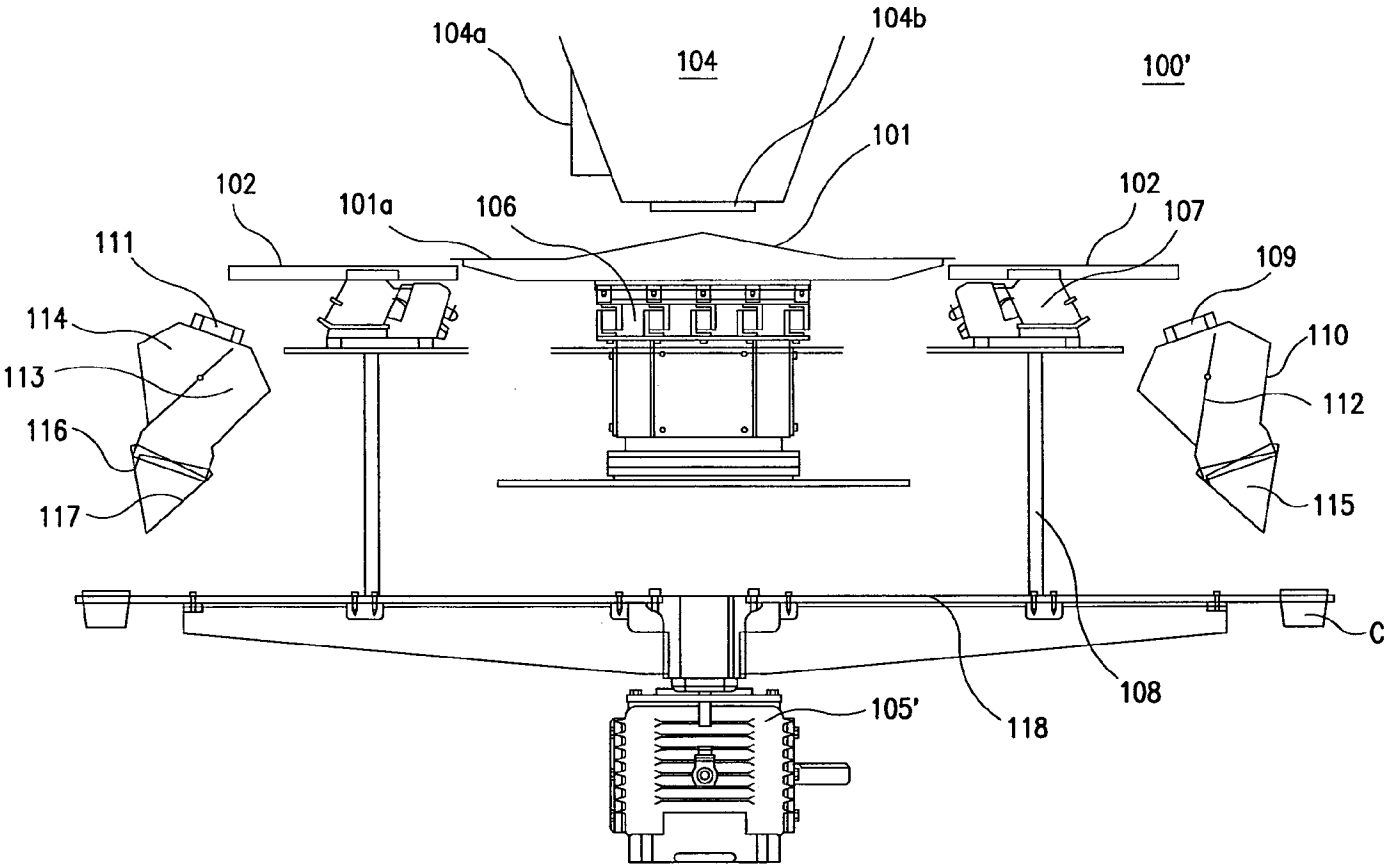
FIG. 8 shows a cross-sectional view of a dispenser according to another embodiment of the present invention.

Referring to FIG. 8, a dispensing system 100' according to another embodiment of the present invention is depicted. The features and advantages of dispensing system 100' are substantially similar to the features and advantages of dispensing system 100. Therefore, the similar features and advantages of dispensing system 100 and dispensing system 100' are not discussed further with respect to dispensing system 100'. Dispensing system 100' may comprise feeder bowl 101, dispensing paths 102 positioned around feeder bowl 101, a dispensing path rotation drive 105' for rotating dispensing paths 102, feeder bowl vibration device 106, and the one or more dispensing path vibration devices 107 for vibrating each dispensing path 102. In this embodiment of the present invention, feeder bowl vibration device 106 may vibrate feeder bowl 101, the one or more dispensing path vibration devices 107 may vibrate dispensing paths 102, and dispensing path rotation drive 105' may rotate dispensing paths 102 around feeder bowl 101. For example, an edge of dispensing paths 102 may be positioned below and may overlap a portion of feeder bowl 101, such that at least one vertical plane includes both dispensing paths 102 and feeder bowl 101. Moreover, in this embodiment of the present invention, feeder bowl 101 does not rotate. Consequently, a lighter motor may be used, there are fewer moving parts is dispensing system 100', and dispensing system 100' may have increased control.

While the invention has been described in connection with preferred embodiments, it will be understood by those of ordinary skill in the art that other variations and modifications of the preferred embodiments described above may be made without departing from the scope of the invention. Moreover, other embodiments of the present invention will be apparent to those of ordinary skill in the art from a consideration of the specification or a practice of the invention disclosed herein, or both.

What is claimed is:

1. A system for dispensing items comprising;

a dispenser comprising a plurality of dispensing paths for dispensing said items;

a sensing unit for measuring a physical characteristic of each of said dispensed items;

a plurality of container chutes for directing each of said dispensed items, the measured physical characteristic of which is within a predetermined range of physical characteristics, to containers; and a plurality of diversion chutes for diverting each of said dispensed items, the measured physical characteristic of which is greater than or less than said predetermined range of physical characteristics, away from said containers, wherein said dispenser comprises:

a feeder bowl for receiving said items and for supplying said items to said plurality of dispensing paths;

a first vibration device for vibrating said feeder bowl;

a rotation drive for rotating said each of said dispensing paths; and at least one second vibration device for vibrating each of said dispensing paths, wherein a control unit controls a rotational speed of said rotation drive and a vibration of said at least one second vibration device, such that said dispensing paths dispense said items singularly.

2. The system of claim 1, wherein said dispenser comprises a dispensing head positioned adjacent to each of said plurality of dispensing paths to receive said dispensed items.

3. The system of claim 2, further comprising:

a star wheel, wherein said star wheel comprises a plurality of container-receiving grooves for positioning each of said containers in alignment with one of said dispensing heads and one of said container chutes to receive said dispensed items.

4. The system of claim 1, wherein said physical characteristic comprises a volume, a weight, or a density of each of said dispensed items.

5. The system of claim 2, wherein each of said plurality of dispensing paths comprises one or more item-dispensing channels and wherein said sensing unit and said dispensing head are positioned adjacent to each of said one or more item-dispensing channels.

6. The system of claim 1, further comprising;

said control unit for receiving said measured physical characteristic of each of said dispensed items from said sensing unit and comparing said measured physical characteristic of each of said dispensed items to a predetermined range of physical characteristics for that item.

7. The system of claim 2, further comprising:

said control unit, wherein said sensing unit transmits said measured physical characteristic of each of said dispensed items to said control unit and wherein said control unit activates said dispensing head to direct each of said dispensed items, the measured physical characteristic of which is within said predetermined range of physical characteristics, to one of said plurality of container chutes.

8. The system of claim 7, wherein said control unit activates said dispensing head to divert each of said dispensed items, the measured physical characteristic of which is greater than or less than said predetermined range of physical characteristics, to one of said diversion chutes.

9. A system for dispensing items comprising:

a dispenser comprising a plurality of dispensing paths for dispensing said items;

a sensing unit for measuring a physical characteristic of each of said dispensed items;

a plurality of container chutes for directing each of said dispensed items, the measured physical characteristic of which is within a predetermined range of physical characteristics, to containers; and a plurality of diversion chutes for diverting each of said dispensed items, the measured physical characteristic of which is greater than or less than said predetermined range of physical characteristics, away from said containers, wherein said dispenser comprises a dispensing head positioned adjacent to each of said plurality of dispensing paths to receive said dispensed items, wherein said dispensing head comprises:

at least one holding chamber, wherein said at least one holding chamber directs each of said dispensed items, the measured physical characteristic of which is within said predetermined range of physical characteristics, to one of said container chutes and diverts each of said dispensed items, the measured physical characteristic of which is greater than or less than said predetermined range of physical characteristics, to one of said diversion chutes.

10. The system of claim 9, wherein said at least one holding chamber comprises two doors mounted pivotally to said dispensing head.

11. A system for dispensing items comprising:

a dispenser comprising a plurality of dispensing paths for dispensing said items;

a sensing unit for measuring a physical characteristic of each of said dispensed items;

a plurality of container chutes for directing each of said dispensed items, the measured physical characteristic of which is within a predetermined range of physical characteristics, to containers; and a plurality of diversion chutes for diverting each of said dispensed items, the measured physical characteristic of which is greater than or less than said predetermined range of physical characteristics, away from said containers, wherein said dispenser comprises a dispensing head positioned adjacent to each of said plurality of dispensing paths to receive said dispensed items, wherein said dispensing head further comprises:

a first chamber;

a second chamber; and a bifurcation device for directing items to one of said first chamber and said second chamber.

12. A system for dispensing items comprising:

a dispenser comprising a plurality of dispensing paths for dispensing said items;

a sensing unit for measuring a physical characteristic of each of said dispensed items;

a plurality of container chutes for directing each of said dispensed items, the measured physical characteristic of which is within a predetermined range of physical characteristics, to containers; and a plurality of diversion chutes for diverting each of said dispensed items, the measured physical characteristic of which is greater than or less than said predetermined range of physical characteristics, away from said containers, wherein said dispenser comprises a dispensing head positioned adjacent to each of said plurality of dispensing paths to receive said dispensed items; and a star wheel, wherein said star wheel comprises a plurality of container-receiving grooves for positioning each of said containers in alignment with one of said dispensing heads and one of said container chutes to receive said dispensed items, wherein said star wheel further comprises:

a plurality of apertures, wherein each of said plurality of diversion chutes communicates with at least one of said plurality of apertures and wherein said star wheel positions each of said plurality of container chutes and each of said plurality of diversion chutes in alignment with a respective one of said dispensing heads.

13. A system for dispensing items comprising:

a dispenser comprising a plurality of dispensing paths for dispensing said items;

a sensing unit for measuring a physical characteristic of each of said dispensed items;

a plurality of container chutes for directing each of said dispensed items, the measured physical characteristic of which is within a predetermined range of physical characteristics, to containers; and a plurality of diversion chutes for diverting each of said dispensed items, the measured physical characteristic of which is greater than or less than said predetermined range of physical characteristics, away from said containers, wherein said dispenser comprises a dispensing head positioned adjacent to each of said plurality of dispensing paths to receive said dispensed items; and a star wheel, wherein said star wheel comprises a plurality of container-receiving grooves for positioning each of said containers in alignment with one of said dispensing heads and one of said container chutes to receive said dispensed items, further comprising:

a rotation drive for rotating said star wheel, wherein said star wheel positions a respective each of said containers, each of said plurality of container chutes, and each of said plurality of diversion chutes in alignment with a respective one of said dispensing heads.

14. A system for dispensing items comprising:

a dispenser comprising a plurality of dispensing paths for dispensing said items;

a sensing unit for measuring a physical characteristic of each of said dispensed items;

a plurality of container chutes for directing each of said dispensed items, the measured physical characteristic of which is within a predetermined range of physical characteristics, to containers;

a plurality of diversion chutes for diverting each of said dispensed items, the measured physical characteristic of which is greater than or less than said predetermined range of physical characteristics, away from said containers, wherein said dispenser comprises a dispensing head positioned adjacent to each of said plurality of dispensing paths to receive said dispensed items; and said control unit for receiving said measured physical characteristic of each of said dispensed items from said sensing unit and comparing said measured physical characteristic of each of said dispensed items to a predetermined range of physical characteristics for that item, further comprising:

a rotation drive for rotating said dispenser; and at least one vibration device for vibrating each of said dispensing paths, wherein said control unit controls a rotational speed of said rotation drive and a vibration of said at least one vibration device, so that said dispensing paths dispense said items singularly.

15. A system for dispensing items comprising:

a dispenser comprising a plurality of dispensing paths for dispensing said items;

a sensing unit for measuring a physical characteristic of each of said dispensed items;

a plurality of container chutes for directing each of said dispensed items, the measured physical characteristic of which is within a predetermined range of physical characteristics, to containers;

a plurality of diversion chutes for diverting each of said dispensed items, the measured physical characteristic of which is greater than or less than said predetermined range of physical characteristics, away from said containers; and a rejection system, wherein said rejection system comprises a rejection conveyor positioned in communication with said plurality of diversion chutes.

16. The system of claim 15, wherein said rejection conveyor conveys said diverted items from said diversion chutes to a rejection bin.

17. A dispensing system comprising:

a rotary, vibratory dispenser for receiving and dispensing items comprising:

a rotation drive for rotating said dispenser;

a plurality of dispensing paths; and at least one vibration device for vibrating said plurality of dispensing paths, so that said plurality of dispensing paths dispenses said items singularly;

at least one sensing unit for measuring a physical characteristic of each of said singularly-dispensed items;

a plurality of container chutes for directing each of said singularly-dispensed items, the measured physical characteristic of which is within a predetermined range of physical characteristics, to containers; and a plurality of diversion chutes for diverting each of said singularly-dispensed items, the measured physical characteristic of which is greater than or less than said predetermined range of physical characteristics, away from said containers.

18. A dispensing system comprising:

a dispenser for receiving and dispensing items comprising:

a plurality of dispensing paths at least one rotation drive for rotating said plurality of dispensing paths; and at least one vibration device for vibrating said plurality of dispensing paths, such that said plurality of dispensing paths dispenses said items singularly;

at least one sensing unit for measuring a physical characteristic of each of said singularly-dispensed items;

a plurality of container chutes for directing each of said singularly-dispensed items, the measured physical characteristic of which is within a predetermined range of physical characteristics, to containers; and a plurality of diversion chutes for diverting each of said singularly-dispensed items, the measured physical characteristic of which is greater than or less than said predetermined range of physical characteristics, away from said containers.

19. A dispensing method comprising the steps of:

dispensing items from a dispenser;

measuring a physical characteristic of each of said dispensed items;

delivering said items to and holding said items within at least one holding chamber;

directing each of said items the measured physical characteristic of which is within a predetermined range of physical characteristics from said at least one holding chamber to a container chute; and diverting each of said items the measured physical characteristic of which is greater than or less than said predetermined range of physical characteristics from said at least one holding chamber to a diversion chute.

20. The method of claim 19, further comprising the step of:

guiding said diverted items to a rejection conveyor.

21. The method of claim 20, further comprising the step of:

conveying said diverted items from an outlet of said diversion chute to a rejection bin.

22. The method of claim 19, further comprising the steps of:

identifying each of said dispensed items, the measured physical characteristic of which is within a predetermined range of physical characteristics; and identifying each of said dispensed items, the measured physical characteristic of which is greater than or less than a predetermined range of physical characteristics.

23. The method of claim 19, wherein the step of measuring a physical characteristic of each of said dispensed items comprises the step of measuring a density, a weight, or a volume of each of said dispensed items.

24. The method of claim 19, wherein the step of dispensing items comprises the step of dispensing items from a plurality of item-dispensing channels.

25. The method of claim 19, wherein the step of directing said items to said container chute comprises the step of directing a predetermined quantity of items to said container chute.

26. The method of claim 19, further comprising the steps of:

directing said items through said container chute to a container.

27. A dispensing method comprising the steps of:

dispensing items from a dispenser;

measuring a physical characteristic of each of said dispensed items;

directing each of said items the measured physical characteristic of which is within a predetermined range of physical characteristics to a container chute;

diverting each of said items the measured physical characteristic of which is greater than or less than said predetermined range of physical characteristics to a diversion chute; and guiding said diverted items to a rejection conveyor.

* * * * *